US006015148A

United States Patent [19]

Cho

[11] Patent Number: 6,015,148

[45] Date of Patent: Jan. 18, 2000

[54] LASER BEAM PRINTER WITH VARIABLE PAPER FEEDING CAPACITY

[75] Inventor: Won-Mo Cho, Suwon, Rep. of Korea

[73] Assignee: Samsung Electronics Co., Ltd., Kyungki-do, Rep. of Korea

[21] Appl. No.: 08/864,270

[22] Filed: May 27, 1997

[30] Foreign Application Priority Data

May 25, 1996 [KR] Rep. of Korea ..... 96-17857
May 8, 1997 [KR] Rep. of Korea ..... 97-17571

[51] Int. Cl.[7] ..... B65H 1/08; B65H 1/00

[52] U.S. Cl. ..... 271/164; 271/147; 271/9.09; 271/162

[58] Field of Search ..... 271/9.01, 9.06, 271/9.09, 162, 3.08, 147, 117, 164

[56] References Cited

U.S. PATENT DOCUMENTS 4,593,895 6/1986 Myers et al. ..... 271/148
5,000,596 3/1991 Naruki .
5,002,266 3/1991 Kikuchi et al. ..... 271/3.2
5,100,123 3/1992 Kagiura et al. ..... 271/164
5,201,507 4/1993 Tokuda .
5,415,386 5/1995 Belc et al. .
5,563,698 10/1996 Okada .
5,581,289 12/1996 Firl et al. .
5,794,928 8/1998 Araseki et al. ..... 271/9.08

*Primary Examiner*—Donald P. Walsh
*Assistant Examiner*—Daniel K Schlak
*Attorney, Agent, or Firm*—Robert E. Bushnell, Esq.

[57] ABSTRACT

A laser beam printer with variable paper feeding capacity includes a body having a cassette mounting portion with a paper feeding device and a cassette mounting rail, at the bottom thereof. This permits the use of a minimum capacity paper cassette and a large capacity paper cassette independently formed with paper holding portions of different capacities. The cassettes may each have a channel along which the cassette mounting rail slides, at both sides thereof, and a plate for supporting paper which receives elasticity from a spring. The printer may make use of a height compensation mechanism installed at the bottom of the body. This mechanism permits the height of the cassette mounting portion of the body to be higher, such as when the large capacity paper cassette is selectively used. Therefore, the printer is efficiently used by selectively employing the minimum capacity paper cassette and large capacity paper cassette, in accordance with usage environment of users.

20 Claims, 11 Drawing Sheets

LASER BEAM PRINTER WITH VARIABLE PAPER FEEDING CAPACITY

CROSS REFERENCE TO RELATED APPLICATION

This application makes reference to, incorporates the same herein, and claims all benefits accruing under 35 U.S.C. §119 from applications for LASER BEAM PRINTER WITH VARIABLE PAPER FEEDING CAPACITY earlier filed in the Korean Industrial Property Office on May 25, 1996 and May 8, 1997, and there duly assigned Ser. Nos. 96-17857 and 97-17571, respectively.

BACKGROUND OF THE INVENTION

1. Field of the Invention

The present invention relates to a laser beam printer for providing paper one by one. More particularly, the present invention relates to an improved laser beam printer with variable paper feeding capacity. The present invention permits plural paper cassettes with different paper holding capacities to be easily and selectively mounted in the printer body.

2. Discussion of Related Art

Today, a laser beam printer is used for relatively high quality printing on a large scale. Thus, the laser beam printer requires a paper delivery and feeding that is relatively exact. If the paper supply is either too much or too little, this may either raise the cost of manufacturing or unnecessarily increase the size of the laser beam printer or even increase the chance of breakdown by requiring more fragile parts. Thus, a paper supply that is efficient, reliable, easily manufactured, and suitable for a laser beam printer is in demand. Among contemporary practice on this matter, Firl et al. (U.S. Pat. No. 5,581,289, Multi-Purpose Paper Path Component For Ink-Jet Printer, Dec. 3, 1996) discusses a paper path component of a unitary structure. The component permits paper to be loaded manually via a second manual feed path, through a housing. Upon opening a rear access door in the housing, such component is easily removable to facilitate operator access to the paper path and electrical components. Okada (U.S. Pat. No. 5,563,698, Sheet Supply Apparatus Having Manual Insertion Guide, Oct. 8, 1996) discusses a manual insertion guide for supporting a manually inserted sheet. The manual insertion guide has side regulating members for regulating the side edges of the manually inserted sheet. Belec et al. (U.S. Pat. No. 5,415,386, Vertical Feeding System For Inserter, May 16, 1995) discusses an apparatus including: a document transport; at least two hoppers located adjacent the documents on edge; a device for continuously conveying the documents through the document transport. The apparatus also includes a device for intermittently feeding the documents from the hoppers to the document transport. Tokuda (U.S. Pat. No. 5,201,507, Cassette Type Sheet Supplying Device For Using A Plurality Of Standard Cassettes Or A Single Large Cassette, Apr. 13, 1993) discussing joining two or more adjoining spaces for installing standard cassettes therein. The adjoining spaces are joined into a continuous space to enable a large cassette to be installed in lieu of two standard cassettes. Naruki (U.S. Pat. No. 5,000,596, Tray Assembly Of A Printer, Mar. 19, 1991) discusses a pair of plate-shaped adapters detachably attached to the interior sides of the side walls of the manual feed tray. The interior side surfaces of the adapters determine, when attached to the manual feed tray, the lateral position of the sheet of paper fed into the printer from the manual feed tray. When the manual feed tray is used without the adapters, the interior side surfaces of the side walls of the manual feed tray determines the lateral position of a manually fed sheet of paper. From my study of the contemporary practice and art, I find that there is a need for a more effective paper supply to a laser beam printer that permits attachment of paper cassettes of different sizes.

SUMMARY OF THE INVENTION

Thus, an object of the present invention is to provide an improved laser beam printer with variable paper feeding capacity.

Another object of the present invention is to provide a laser beam printer with variable paper feeding capacity, in which plural paper cassettes operate with the same driving mechanism as a printer body, and in which the paper cassettes with different paper holding capacity are easily and selectively mounted in the body.

To achieve these and other advantages, the printer of the present invention comprises more than two paper cassettes which have different paper holding capacity. When the paper cassette with the large capacity is necessary among the cassettes, a member for compensating a height is installed at the bottom of the body. This is largely for compensating for the height of a cassette mounting portion where the paper cassette is fixed. When the paper cassette with the small capacity is used, the member for compensating a height is separated from the body, and the paper cassette with the small capacity is assembled with the body.

The printer may include a body having a cassette mounting portion with a cassette mounting rail, at the bottom thereof This can accommodate more than two paper cassettes with minimum and large paper holding capacity, each having a channel along which the cassette mounting rail slides, at both sides thereof, and a plate for supporting paper which receives elasticity from a spring. A height compensation mechanism can be installed at the bottom of the body, for making the height of the cassette mounting portion higher. This can happen when the paper cassette with large paper holding capacity is selectively used.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
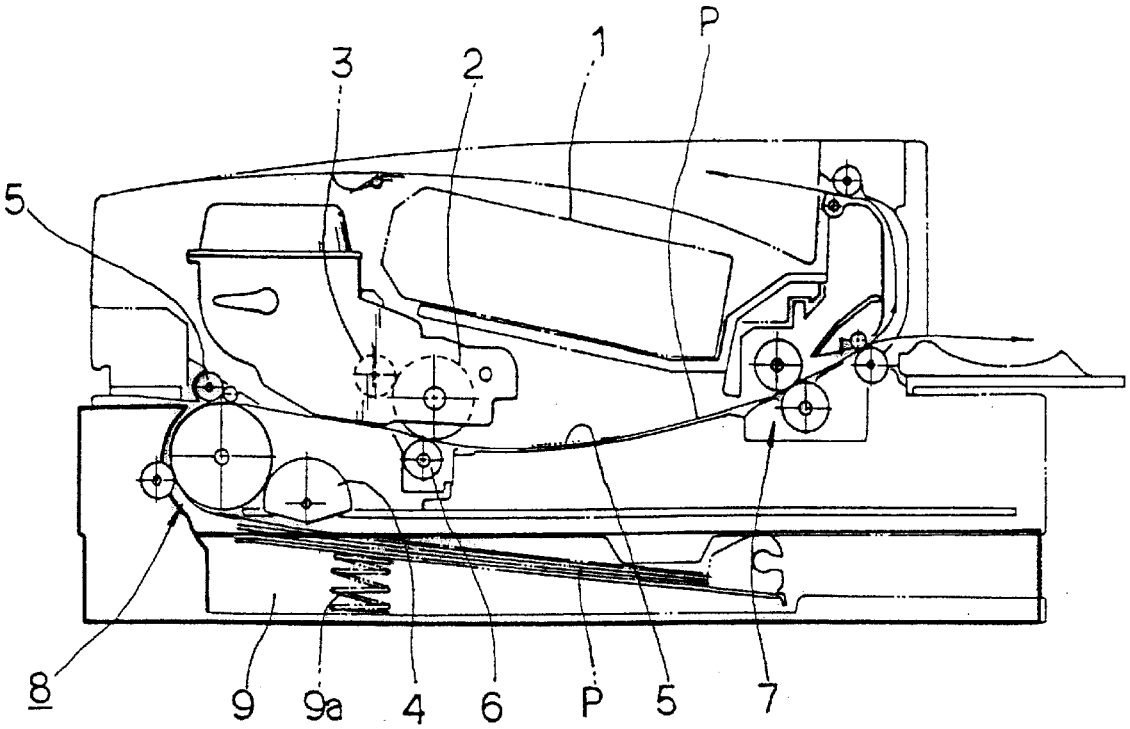
FIG. 1 is a schematic diagram illustrating a side of a contemporary laser beam printer.
Figure 2:
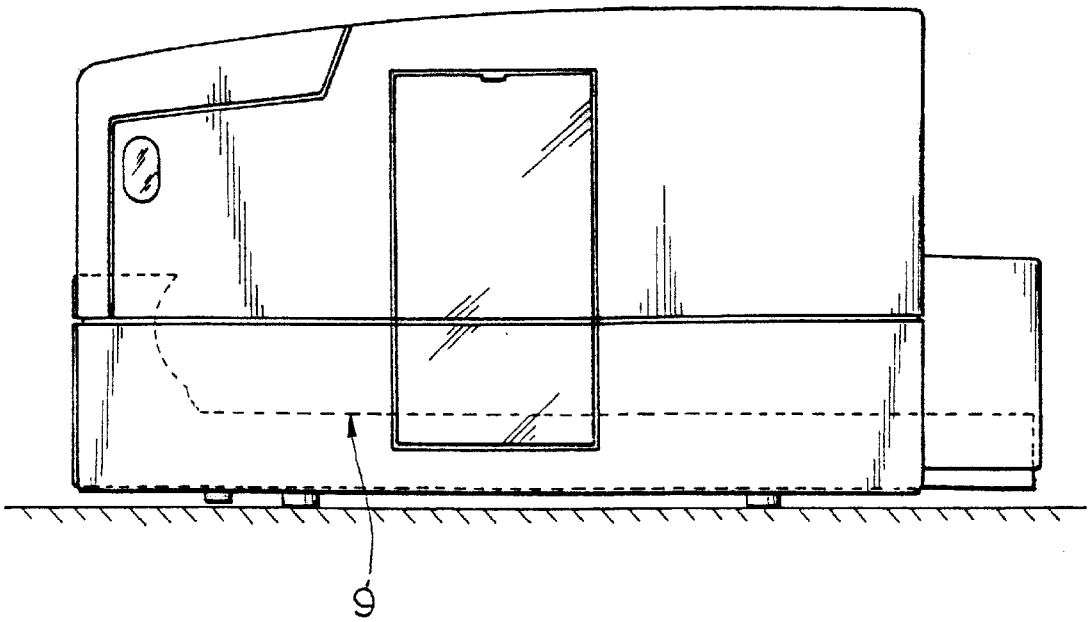
FIG. 2 is a side view of the contemporary laser beam printer.

Turning now to the drawings, as shown in FIG. 1, in a contemporary laser beam printer, a photosensitive drum 2 receives a light signal from a light source 1. This forms an electrostatic latent image by the light signal. While the photosensitive drum 2 rotates, a toner T moves to the electrostatic latent image by electric power. This moves to a developing roller 3 to which the toner is stuck. Paper P in a paper cassette 9 is maintained with application of fixed feeding pressure with a pick up roller 4 by the proper pressure of a spring 9*a*.

Paper P is fed one by one through operation of the pick up roller 4, delivered to a line up roller 5, and conveyed while in contact with the surface of the photosensitive drum 2. This matches the latent image of the photosensitive drum 2 at the proper time. High voltage, a greater voltage than the electric adhesive power of the photosensitive drum 2 and the toner, is applied across a transfer device 6. This conveys the latent image to the paper. The paper which is stained with the toner, is conveyed to a fixing device 7. The toner is fused to the paper by heating. The laser beam printer with such a principle and operation, includes a paper feeding device 8 for feeding the paper P one by one. The paper feeding device 8 also includes a paper cassette 9 which is filled with multiple sheets of paper P. Many models of printers are limited to only one paper cassette 9. Accordingly, the paper cassette 9 cannot send more paper. The paper feeding capacity of the paper cassette 9 plays a very important part in accordance with usage environment.

When a person uses the laser beam printer at home, the paper cassette usually holds less than 100 sheets of paper. When several people require great quantities of paper in office, the paper cassette should hold more than 500 sheets of paper, in order to supplement the paper in the paper cassette. Accordingly, the paper cassettes have been hitherto manufactured to hold 150 or 250 sheets of paper, and only one among them is employed, in accordance with the consumer's intention. The consumer is apt to purchase the printer with the paper cassette for holding less papers, in order to use it at home. In contrast, the printer with the paper cassette for holding more papers tends to be used in office. There are, of course, some exceptions. Less paper and more paper are not always used in home and office, respectively. This is determined in accordance with usage environment of users.

The contemporary laser beam printer employs only one of the paper cassettes for holding 150 or 250 sheets of paper, without consideration of usage environment of users. When less sheets of paper are used through the printer with the paper cassette for holding more sheets of paper, the printer takes up the unnecessarily broad space, due to the large-sized paper cassette. When more sheets of paper are used through the printer with the paper cassette for holding less sheets of paper, paper should be frequently supplemented, due to the small paper holding capacity of the paper cassette. In order to solve the problem, a separate optional second cassette is provided for holding multiple sheets of paper, which was filed under Korean Application No. 96-3501. The second cassette operates separately, irrespective of the printer body so that the price thereof is high. The size of the second cassette is very large, as compared with its paper holding capacity so that it is not economical and efficient for general printer users.

Figure 3:
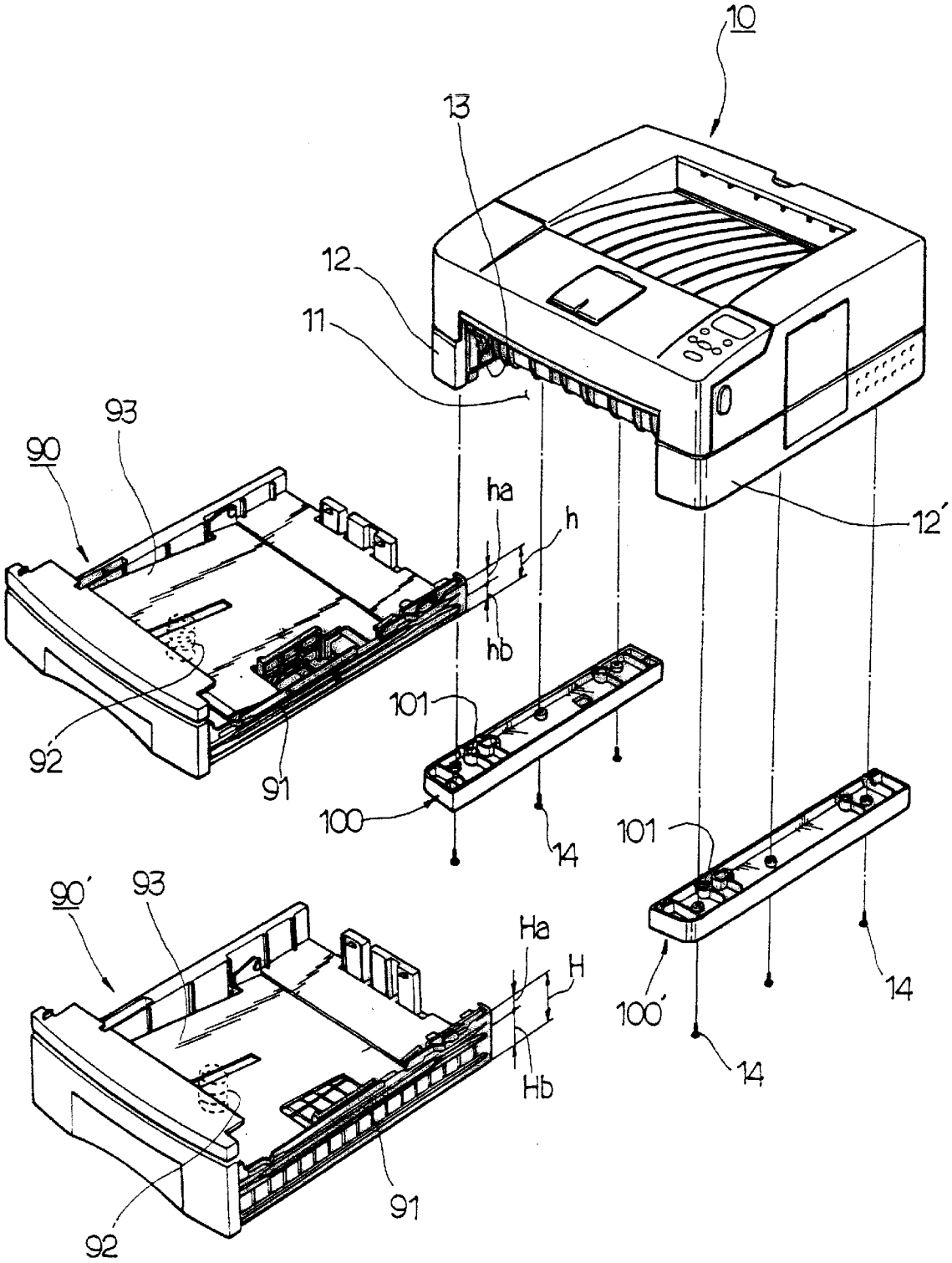
FIG. 3 is an exploded perspective view of portions of a laser beam printer built according to the principles of the present invention.
Figure 4:
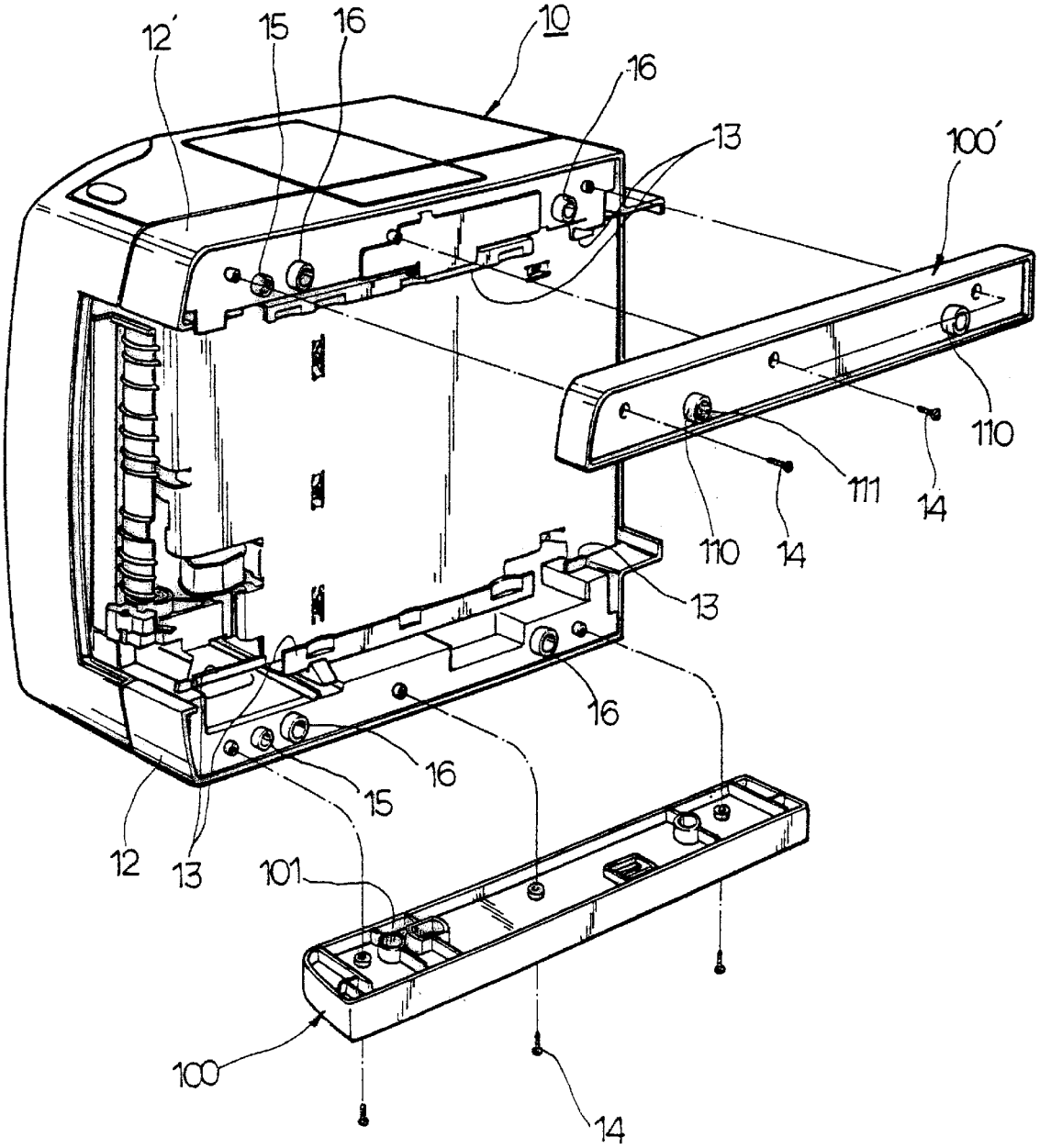
FIG. 4 is an exploded perspective view of portions of a laser beam printer according to a first preferred embodiment of the present invention.

FIGS. 3 through 7 show a different approach. FIGS. 3 through 7 illustrate the first preferred embodiment of the present invention. A cassette mounting portion 11 is formed at the bottom of a body 10, and body bottoms (which may have body bottom members) 12 and 12' are formed at both sides of the cassette mounting portion 11. As shown in FIG. 3, a cassette mounting rail 13 is provided at the upper portion inside the body bottoms 12 and 12'. When one of paper cassettes 90 and 90' is selectively inserted into the cassette mounting portion 11, the cassette mounting rail 13 "mates" (effectively matches) with a channel 91 which is formed at both sides of the paper cassette 90 or 90'. After one of paper cassettes 90 and 90' is completely mounted in the cassette mounting portion 11, the cassette mounting rail 13 is interrupted by the channel 91, so that the paper cassette 90 or 90' itself is supported by the body 10. In the present invention, at least two paper cassettes 90 and 90' can be provided to be selectively mounted at the cassette mounting portion 11.

Figure 5:
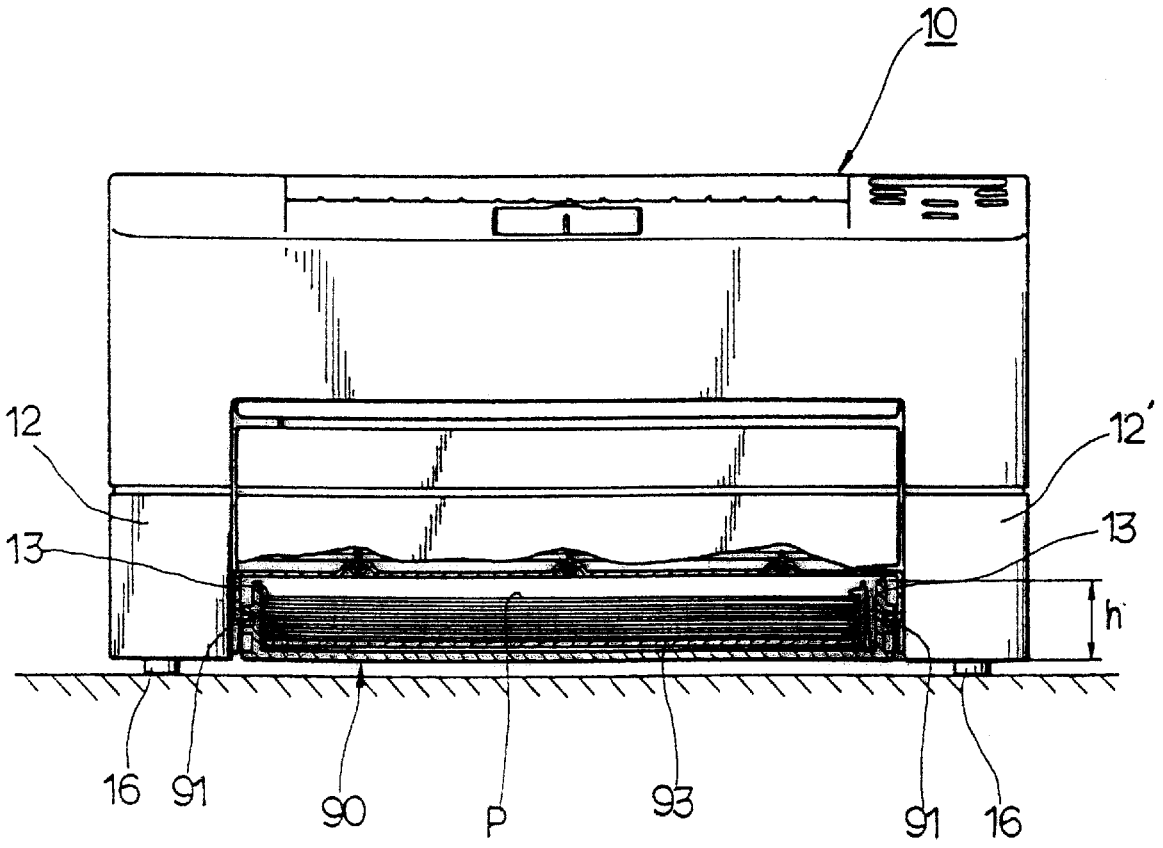
FIG. 5 is a frontal view of a printer, which shows a section of an important portion of the printer where a first cassette is mounted, according to the present invention.

The paper cassette 90 or 90' includes a paper supporting plate 93 which receives elasticity from a spring 92, and a handle 94 by which they are inserted into or pulled out of the body 10. A paper holding portion 94 is formed at the top of the paper supporting plate 93, where paper P is accumulated. The paper cassettes 90 and 90' of the present invention have the paper holding portions 94 whose respective paper holding areas are different from each other. Referring to FIG. 3, the length and breadth of the paper holding portions 94 of two paper cassettes 90 and 90' are the same size, but the heights h and H thereof are dissimilar to each other. The heights ha and Ha where the channel 91 stands, are same, at both sides of the top of the paper cassettes 90 and 90'. The heights hb and Hb from the channel 91 to the bottom of the paper cassettes 90 and 90' are different Accordingly, there is the difference between the heights h and H of the paper holding portions 94 of the paper cassettes 90 and 90' so that the paper holding capacity differs in the respective cassettes Hereinafter, the cassette with a lower height h and less sheets of paper is referred to as a minimum capacity paper cassette, and the cassette with a higher height H and more sheets of paper is referred to as a large capacity paper cassette. As depicted in FIG. 5, if the minimum capacity paper cassette 90 is fixed at the cassette mounting portion 11 of the body 10, the bottom of the body bottoms 12 and 12' is flush with that of the minimum capacity paper cassette 90. When the minimum capacity paper cassette 90 is taken out of the cassette mounting portion 11 before the large capacity paper cassette 90' is inserted in order to feed more sheets of paper, the height H of the large capacity paper cassette 90' is larger than that of the cassette mounting portion 11 which is formed in the body 10 itself, so that the large capacity paper cassette 90' cannot be fixed. When the large capacity paper cassette 90' is selectively fixed, accordingly, height compensation members 100 and 100' which are height compensation means, are separately provided at the bottom of the body bottoms 12 and 12', in order to increase the height of the cassette mounting portion 11 of the body 10.

The height compensation members 100 and 100' can take the same shape as the bottom of the body bottoms 12 and 12', and have the same height as the height difference between the minimum capacity paper cassette 90 and the large capacity paper cassette 90'. The height compensation members 100 and 100' are fixed at the bottom of the body bottoms 12 and 12' by multiple fixing screws 14. Here, position determination projection 15 of the body bottoms 12 and 12' is inserted into position determination recess 101 so that the body bottoms 12 and 12' and the height compensation members 100 and 100' are correctly positioned. Supporting projections 16 and 110 are formed at the front and back bottoms of the body bottoms 12 and 12' and height compensation members 100 and 100', respectively. A rubber support 111 is fitted in the front supporting projection 110 of the height compensation members 100 and 100'.

The rubber support 111 has a high friction coefficient, and therefore serves to prevent the body 10 from slipping. The present invention can function even when only one or no rubber support 111 is provided. This is because the weight of the body 10 itself is considerable. Therefore, the weight of the body 10 itself can prevent the slipping of the body 10 unless any optional outer force is applied to the body 10.

Figure 6:
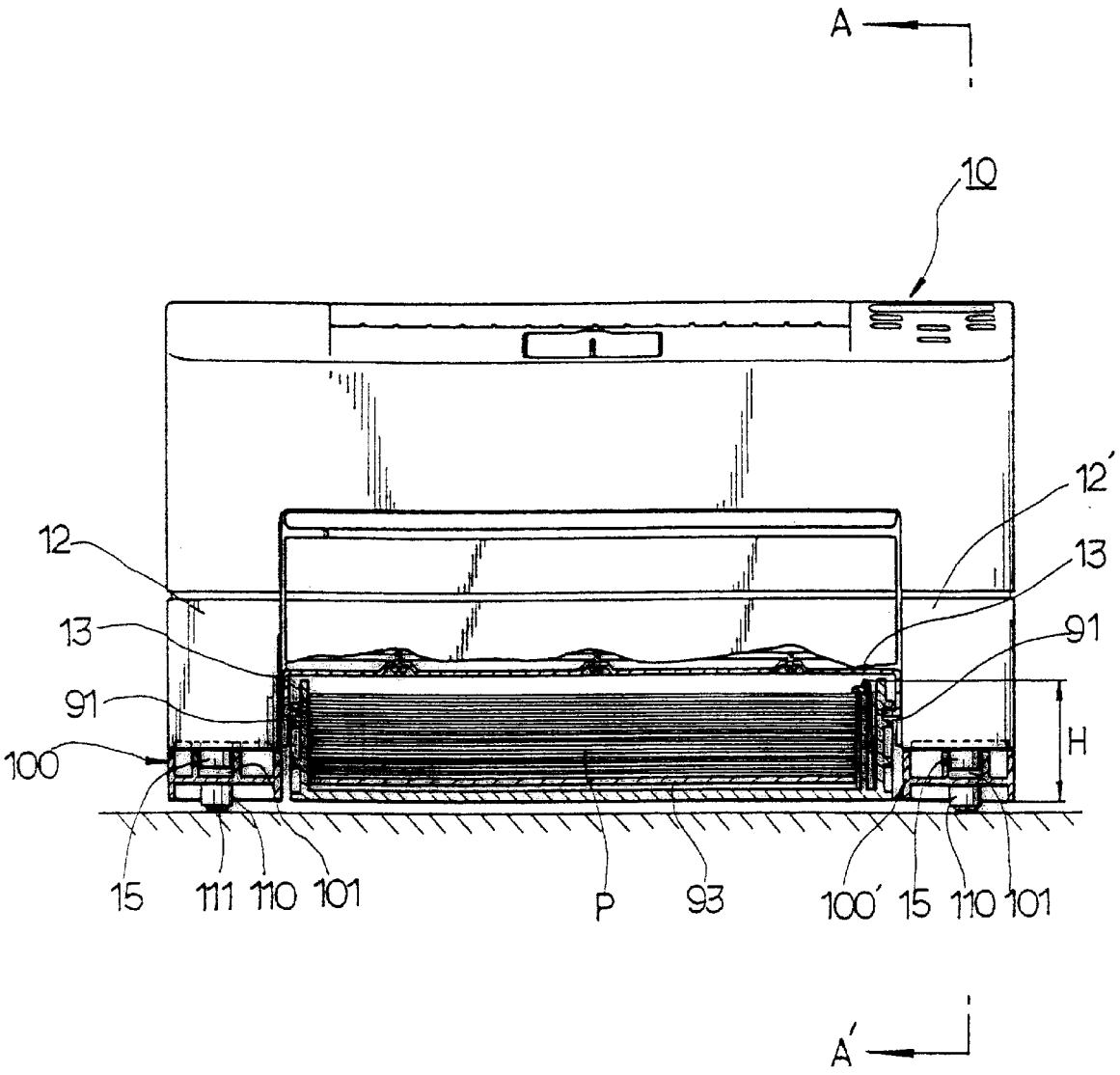
FIG. 6 is a frontal view of a printer, which shows a section of an important portion of the printer where a second cassette is mounted, according to the present invention.
Figure 7:
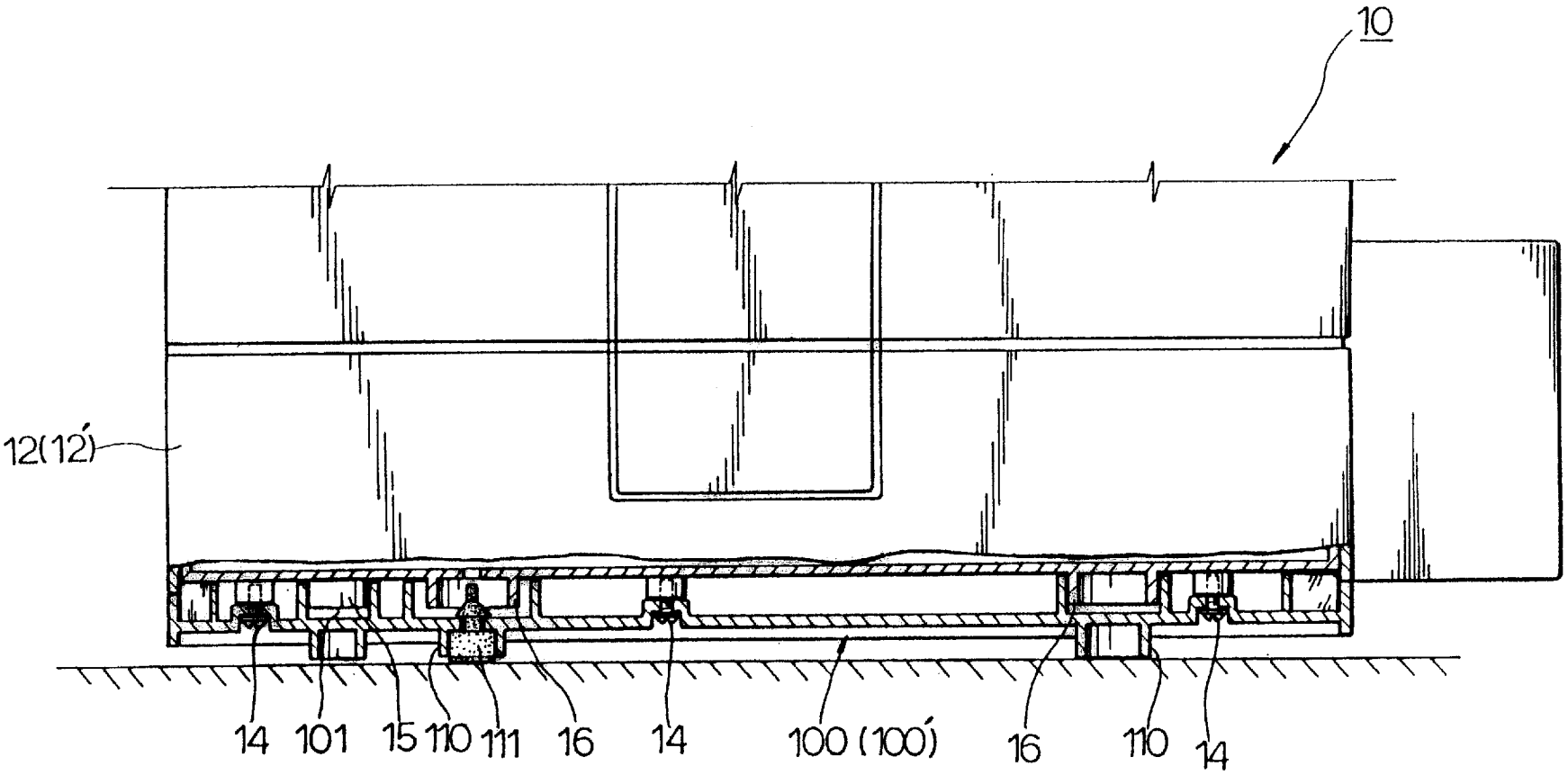
FIG. 7 is a sectional view taken along the lines A–A' of FIG. 6.

FIG. 6 shows the state of the large capacity paper cassette 90' which is inserted into the cassette mounting portion 11, according to the present invention. The minimum capacity paper cassette 90 is pulled out of the cassette mounting portion 11, before the body 10 lies on its side. And the height compensation members 100 and 100' are coupled with the body bottoms 12 and 12' with the fixing screws 14, respectively. Accordingly, the height of the cassette mounting portion is increased. The body 10 which lies on its side, is made to stand before the large capacity paper cassette 90' is fixed in the cassette mounting portion 11 whose height is increased. Accordingly, the bottom of the large capacity paper cassette 90' is flush with that of the height compensation members 100 and 100'. The large capacity paper cassette 90' is taken out of the cassette mounting portion 11, in order to be replaced with the minimum capacity paper cassette 90, before the body 10 lies on its side. And the screws 14 are loosened in order to separate the height compensation members 100 and 100' from the body 10, before the minimum capacity paper cassette 90 is inserted into the cassette mounting portion 11 whose height is decreased.

Figure 8:
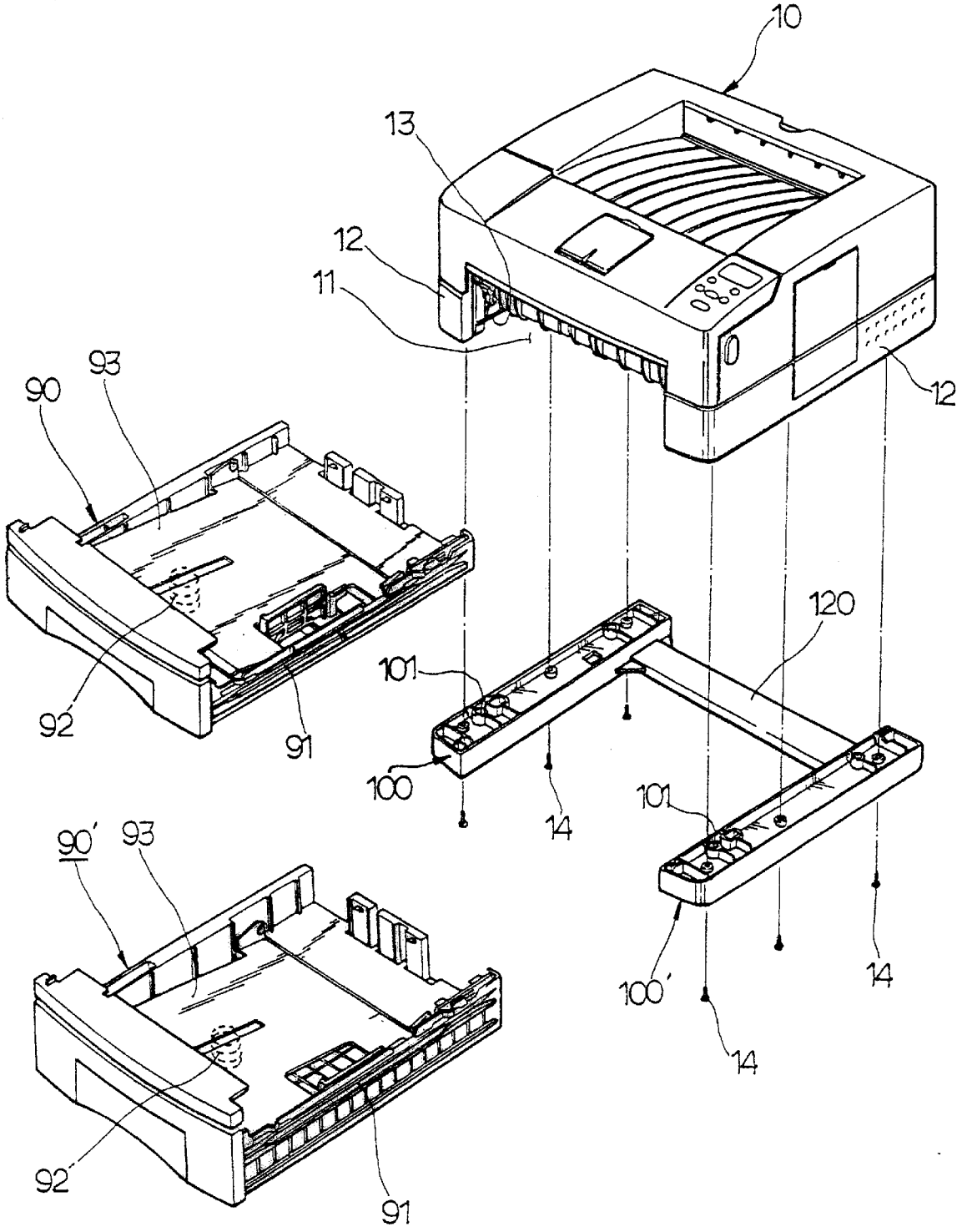
FIG. 8 is an exploded perspective view of important portions of a laser beam printer according to a second preferred embodiment of the present invention.
Figure 9:
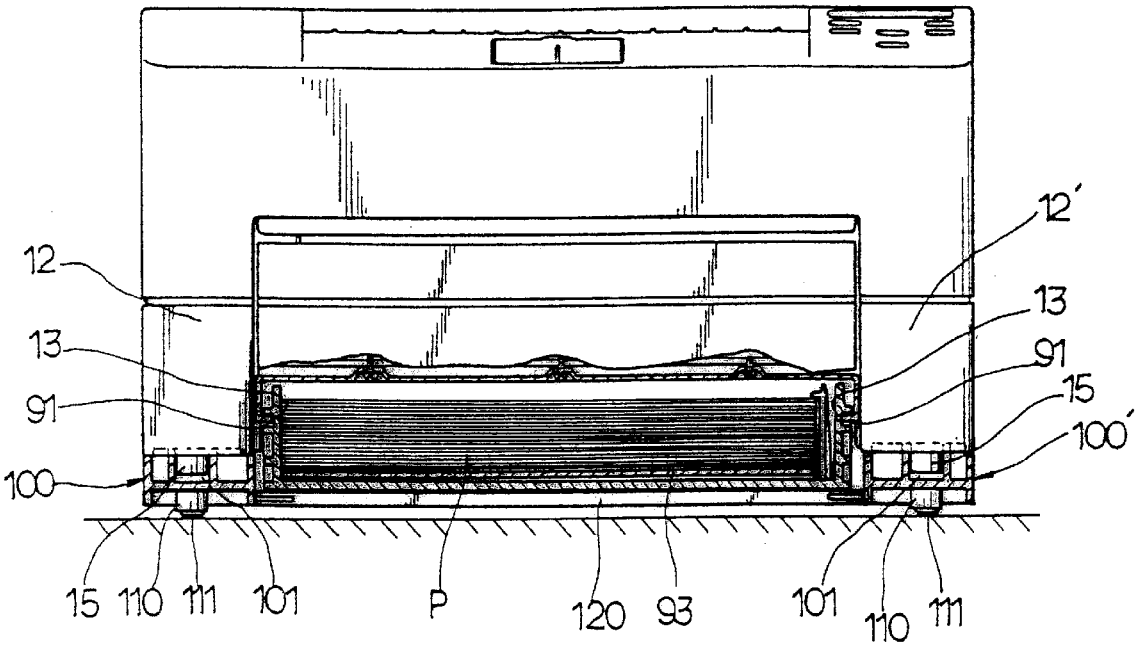
FIG. 9 is a frontal view of a printer, illustrating a section of an important portion of the printer where a cassette with large paper holding capacity is mounted, according to the second preferred embodiment of the present invention.

FIGS. 8 and 9 show the second preferred embodiment of the present invention. The second preferred embodiment differs from the first preferred embodiment in the structure of the height compensation members 100 and 100'. The height compensation members 100 and 100' form the respective body bottoms 12 and 12' at both sides of the cassette mounting portion 11, and thus should be in pairs. In case that the height compensation members 100 and 100' are parts which are independently made, according to the first preferred embodiment, one of them is likely to be lost and the large capacity paper cassette 90' cannot be used. Accordingly, the height compensation members 100 and 100' are connected to each other with a connecting piece 120, in order to be one part A separate member may connect the height compensation members 100 and 100' by using proper fixing means, but the height compensation members 100 and 100' and the connecting piece 120 are integrally formed in a mold because the height compensation members 100 and 100' are fabricated with the same material as the body 10. The integrally formed height compensation members 100 and 100' take up much keeping space, but the danger of losing them is considerably removed. These 15 members have the similar and analogous structure and operation as those according to the first preferred embodiment. The explanation thereabout is omitted herein so as to save repetition.

Figure 10:
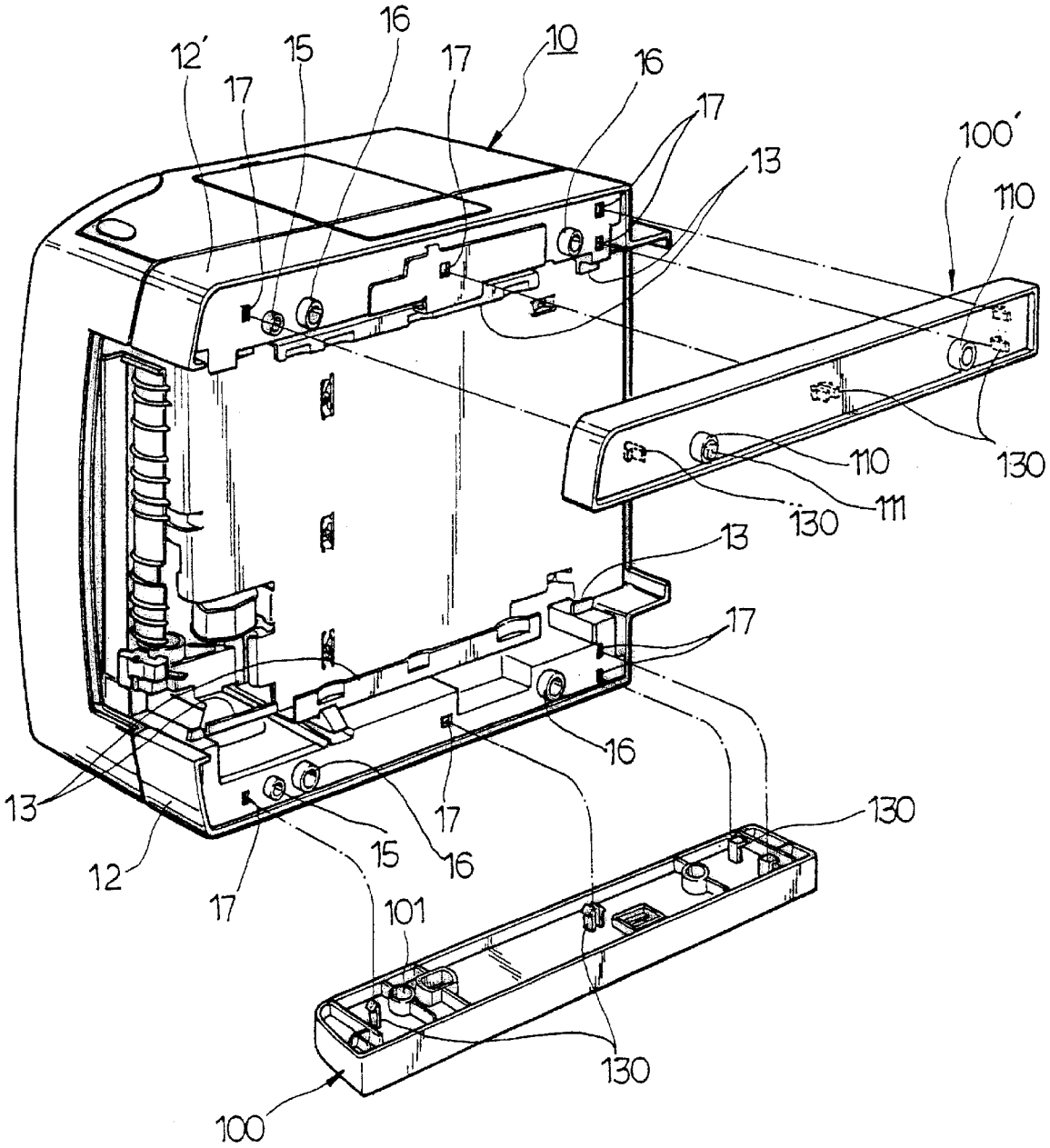
FIG. 10 is an exploded perspective view of important portions of a laser beam printer according to a third preferred embodiment of the present invention.
Figure 11A:
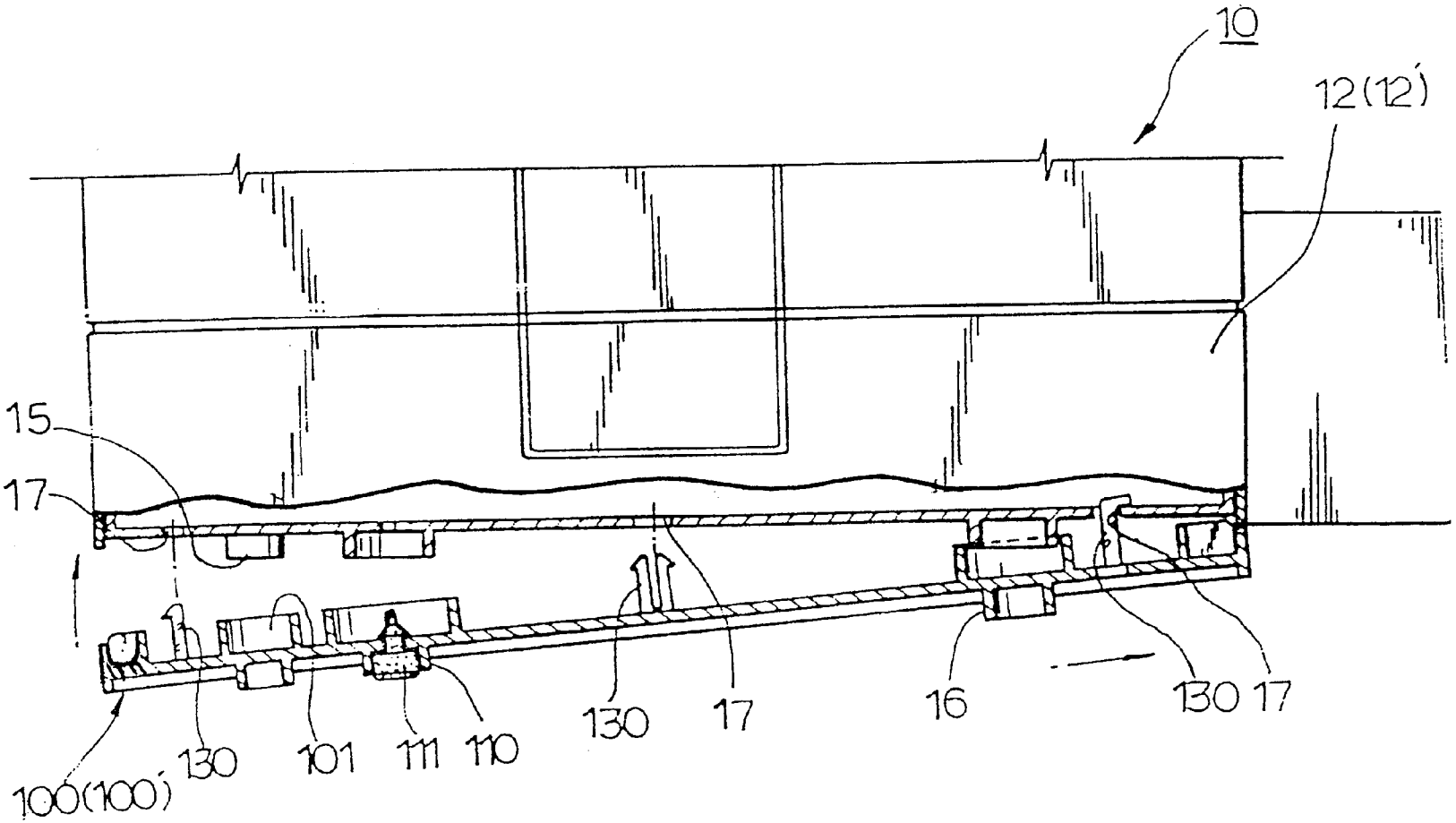
FIG. 11A is a sectional view of a section of the third preferred embodiment of the present invention, illustrating the fixation of a height control member.
Figure 11B:
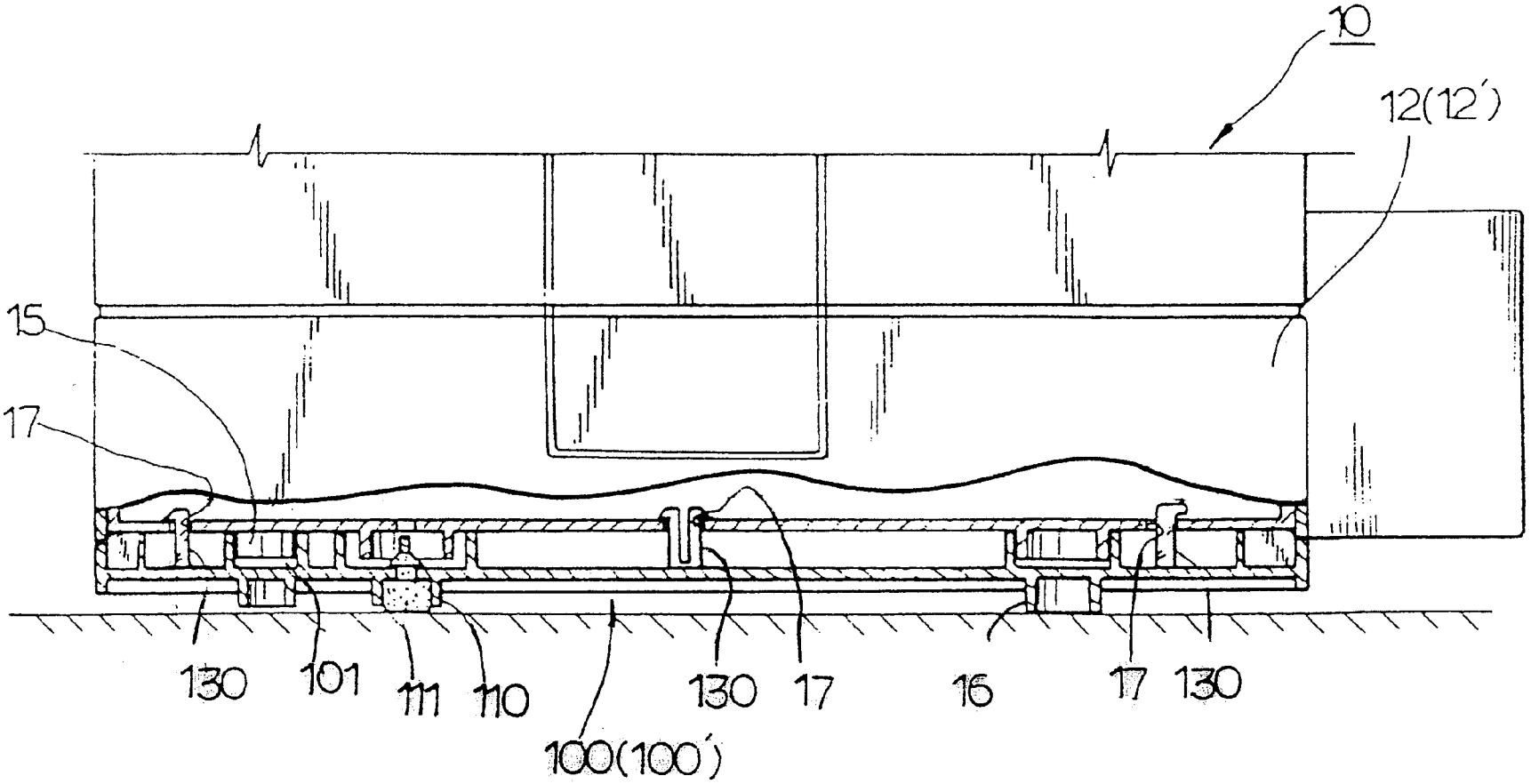
FIG. 11B is a sectional view of illustrating a section of the printer where the height control member is mounted, according to the third preferred embodiment of the present invention.

FIG. 10 & FIGS. 11A and 11B show the third preferred embodiment of the present invention. The height compensation members 100 and 100' are coupled with the bottom of the body bottoms 12 and 12', by means of hooks, not the fixing screws of the first and second preferred embodiments. The fixing screws 14 which are the separate small parts, are apt to be lost. It is troublesome to tighten up/loosen the screws. Multiple hooks 130 are formed on the top of the height compensation members 100 and 100'. As shown in FIGS. 11A and 11B, the hooks 130 are inserted into apertures 17 formed on the bottom of the body bottoms 12 and 12', respectively, so that the height compensation members are coupled with the bottom of the body bottoms.

The height compensation members 100 and 100' with the hooks 130 are pushed toward the body bottoms 12 and 12', in order to be coupled, and oppositely pulled in order to be disassembled. The height compensation members 100 and 100' are held, pulled and separated from the apertures 17. This uses a considerable amount of force. The height compensation members 100 and 100' can be coupled with the bottom of the body bottoms 12 and 12', through any fixing mechanisms as well as the fixing screws 14 and hooks 130.

As stated above, users may selectively employ the paper cassettes with proper paper feeding capacity, in accordance with usage environment of the printer. Thus, the printer can be efficiently used. The paper cassettes with different paper feeding capacity are simply and easily replaced with each other, whenever necessary. The reliability of products is enhanced. Further, this is done with relatively simple structure and variable paper feeding capacity. The present invention is applied not only to the laser beam printer, but also to a duplicate machine and a facsimile which operate through the same principle and have the same paper feeding device as the laser beam printer. Therefore, it can be broadly applied.

It will be apparent to those skilled in the art that various modifications and variations can be made in a laser beam printer with variable paper feeding capacity of the present invention without departing from the spirit or scope of the invention. Thus, it is intended that the present invention cover the modifications and variations of this invention provided they come within the scope of the appended claims and their equivalents.

What is claimed is:

1. A method of assuring supply of paper to a printer with variable paper feeding capacity, comprising the steps of:

providing a body; forming a cassette mounting portion disposed on bottom side of said body, having a paper feeding device, a plurality of sidewalls with a first height, and cassette mounting rails forming, and providing a first space between said sidewalls;

forming a minimum capacity paper cassette having a first paper holding portion of a first paper holding capacity, first cassette channels permitting said cassette mounting rails to slide, and the same height as said first height of said sidewalls, and being accommodated into said first space;

forming a large capacity paper cassette having a second paper holding portion of a second paper holding capacity greater than said first paper holding capacity, second channels permitting said cassette mounting rails to slide, and a second height longer than said first height of said sidewalls and occupying a second space larger than said first space; and providing a plurality of height compensators attached to said side walls, having approximately same height as difference in height between said first height and said second height and approximately same as difference in space between said first space and said second space so as to accommodate said large capacity paper cassette when said large capacity paper cassette is inserted into said cassette mounting portion in place of said minimum capacity paper cassette.

2. The method of claim 1, wherein length and width of said first paper holding portion of said minimum capacity paper cassette and length and width of said second paper holding portion of said large capacity paper cassette are of approximately same dimension, and height of said first paper holding portion of said minimum capacity paper cassette and height of said second paper holding portion of said large capacity paper cassette are of different dimensions.

3. The method of claim 1, wherein said height compensator has approximately same length and width as said sidewall.

4. The method of claim 1, wherein height of said height compensator is approximately same as difference in height between said minimum capacity paper cassette and said large capacity paper cassette.

5. The method of claim 1, further comprised of the step of attaching and securing said height compensators with securing screws and securing hooks to said sidewalls.

6. The method of claim 1, wherein said height compensators are two, separable height compensation members.

7. The method of claim 6, further comprised of the step of connecting two height compensation members each other via a connecting piece.

8. The method of claim 1, further comprises of the step of allowing position determination projections of said sidewalls into position determination recesses formed on said height compensators.

9. A printer with variable paper feeding capacity, comprising:

a body;

a cassette mounting portion located on a bottom side of said body, having a paper feeding device, a plurality of sidewalls with a first height, and cassette mounting rails, and providing a first space between said sidewalls;

a minimum capacity paper cassette having a first paper holding portion of a first paper holding capacity and first cassette channels permitting said cassette mounting rails to slide, said first paper holding portion having the same as said first height so as to fit into said first space when said minimum capacity paper cassette is inserted into said cassette mounting portion;

a large capacity paper cassette having a second paper holding portion of a second paper holding capacity greater than said first paper holding capacity, second channels permitting said cassette mounting rails to slide, said second paper holding portion having a second height longer tahn said first height and occupying a second space larger than said first space; and at least one height compensation member attached to said sidewalls, having a third height compensating a difference in height between said first height and said second height and providing a third space compensating a difference in space between said first space and said second space so as to provide the same as said second space and accommodate said large capacity paper cassette when said large capacity paper cassette is inserted into said cassette mounting portion in place of said minimum capacity paper cassette.

10. The printer of claim 9, wherein length and width of said first paper holding portion of said minimum capacity paper cassette and length and width of said second paper holding portion of said large capacity paper cassette are of approximately same dimension, and height of the first paper holding portion of the minimum capacity paper cassette and height of the second paper holding portion of the large capacity paper cassette are of different dimensions.

11. The printer of claim 9, wherein said height compensation members have approximately same length and width as said sidewall.

12. The printer of claim 9, wherein the height of said height compensation members is approximately same as difference in height between the minimum capacity paper cassette and the large capacity paper cassette.

13. The printer of claim 9, wherein said height compensation members are secured with securing screws and securing hooks to bottom side of said side wall.

14. The printer of claim 9, further comprised of each height compensation member attached to each sidewall.

15. The printer of claim 14, further comprised of a connecting piece connecting one height compensation member to the other height compensation member.

16. The printer of claim 9, further comprised of position determination projections formed on said sidewalls and position determination recesses formed on one surface of said height compensation members and accommodating said position determination recesses when said height compensation members are attached to said sidewalls.

17. A printer with variable paper feeding capacity, comprising:

a body;

a cassette mounting portion disposed on said body, having a paper feeding device, a plurality of side walls with a first height to provide a first space between said sidewalls, and cassette mounting rails, said first space accommodating a minimum capacity paper cassette having a first paper holding portion of a first paper holding capacity, first cassette channels permitting said cassette mounting rails to slide, and same height as said first height of said sidewalls;

a large capacity paper cassette having a second paper holding portion of a second paper holding capacity greater than the first paper holding capacity, a second channel permitting said cassette mounting rails to slide, having a second height longer than said first height of said side walls and occupying a second space larger than said first space; and a height compensator attached to said sidewalls, having approximately same as difference between said first space and said second space so as to accommodate said large capacity paper cassette when said large capacity paper cassette is inserted into said cassette mounting portion in place of said minimum capacity paper cassette.

18. The printer of claims 17, further comprised of said height compensator having two separate members.

19. The printer of claim 18, further comprised of a connecting piece connecting one member to the other member.

20. The printer of claim 17, further comprised of said height compensator having approximately same length and width as said side wall.

* * * * *